US010341762B2

(12) United States Patent
Ramalingam et al.

(10) Patent No.: US 10,341,762 B2
(45) Date of Patent: Jul. 2, 2019

(54) DYNAMIC GENERATION AND DISTRIBUTION OF MULTI-CHANNEL AUDIO FROM THE PERSPECTIVE OF A SPECIFIC SUBJECT OF INTEREST

(71) Applicant: SONY CORPORATION, Tokyo (JP)

(72) Inventors: Prabakaran Ramalingam, Bangalore (IN); Madhvesh Sulibhavi, Bangalore (IN); Awadh Bihari Mohan, Bangalore (IN)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/729,884

(22) Filed: Oct. 11, 2017

(65) Prior Publication Data

US 2019/0110125 A1 Apr. 11, 2019

(51) Int. Cl.

| | |
|---|---|
| ***H04R 5/02*** | (2006.01) |
| ***H04R 1/26*** | (2006.01) |
| ***H04R 3/14*** | (2006.01) |
| *H04R 5/00* | (2006.01) |
| *H04R 1/40* | (2006.01) |

(52) U.S. Cl.

CPC ..... *H04R 1/26* (2013.01); *H04R 3/14* (2013.01); *H04R 5/02* (2013.01); *H04R 1/403* (2013.01); *H04R 2203/12* (2013.01); *H04R 2205/022* (2013.01)

(58) Field of Classification Search

CPC ... H04R 1/26; H04R 3/14; H04R 5/02; H04R 1/403; H04N 7/183

USPC ..... 381/307, 17, 310

See application file for complete search history.

(56) References Cited

U.S. PATENT DOCUMENTS

| | | | | |
|---|---|---|---|---|
| 6,195,435 | B1 | 2/2001 | Kitamura | |
| 6,351,733 | B1 | 2/2002 | Saunders et al. | |
| 7,367,886 | B2 | 5/2008 | Loose et al. | |
| 9,185,361 | B2 | 11/2015 | Curry | |
| 2005/0089182 | A1 | 4/2005 | Troughton et al. | |
| 2010/0026809 | A1* | 2/2010 | Curry | H04N 5/222 348/157 |
| 2017/0085985 | A1* | 3/2017 | Kim | H04R 3/005 |
| 2018/0109900 | A1* | 4/2018 | Lyren | H04S 7/304 |

* cited by examiner

*Primary Examiner* — Xu Mei
*Assistant Examiner* — Ammar T Hamid
(74) *Attorney, Agent, or Firm* — Chip Law Group

(57) ABSTRACT

A media content packaging and distribution system for dynamic generation of multi-channel audio includes a server, which stores location information of a plurality of subjects located in a defined area. A subject-of-interest is selected from the plurality of subjects in the defined area. Thereafter, a set of audio-capture devices are selected from the plurality of audio-capture devices. A set of audio streams are received from the selected set of audio-capture devices. A multi-channel audio is generated based on the received set of audio streams. The generated multi-channel audio is communicated to a consumer device. Based on an output of the multi-channel audio by the consumer device, an acoustic environment is reproduced as a surround sound environment at the consumer device from a perspective of the subject-of interest.

20 Claims, 6 Drawing Sheets

DYNAMIC GENERATION AND DISTRIBUTION OF MULTI-CHANNEL AUDIO FROM THE PERSPECTIVE OF A SPECIFIC SUBJECT OF INTEREST

CROSS-REFERENCE TO RELATED APPLICATIONS/INCORPORATION BY REFERENCE

None.

FIELD

Various embodiments of the disclosure relate to multi-channel audio technologies. More specifically, various embodiments of the disclosure relate to a media content packaging and distribution system for dynamic generation of multi-channel audio from the perspective of a specific user.

BACKGROUND

Recent advancements in media content packaging and distribution technologies have made it possible to package together a plurality of disparate audio streams as a multi-channel audio. In conventional systems, prior to generation of the multi-channel audio by use of an audio mixer, human operators (for example, sound engineers) may be required to assign each of the plurality of disparate audio streams into different audio channels of a multi-channel audio system. As a result, the generation of the multi-channel audio may require an excessive degree of human intervention, and may therefore be deemed to be a time intensive and a labor intensive process.

In certain scenarios, a user may be viewing a sports broadcast on a television. The user may desire to experience a surrounding audio environment from the perspective of a specific player in the sports broadcast. Existing broadcast technologies may simply reproduce an audio environment of an area based on pre-defined settings, for example, crowd noise may be routed to be played from rear speaker, and commentary voice may be routed to be played from a center speaker of a multi-channel audio system. As a consequence, the audio output from the multi-channel audio system may be unappealing to potential consumers.

Further limitations and disadvantages of conventional and traditional approaches will become apparent to one of skill in the art, through comparison of described systems with some aspects of the present disclosure, as set forth in the remainder of the present application and with reference to the drawings.

SUMMARY

A media content packaging and distribution system and method for dynamic generation of multi-channel audio from the perspective of a specific user is substantially as shown in, and/or described in connection with, at least one of the figures, as set forth more completely in the claims.

These and other features and advantages of the present disclosure may be appreciated from a review of the following detailed description of the present disclosure, along with the accompanying figures in which like reference numerals refer to like parts throughout.

DETAILED DESCRIPTION

Figure 1:
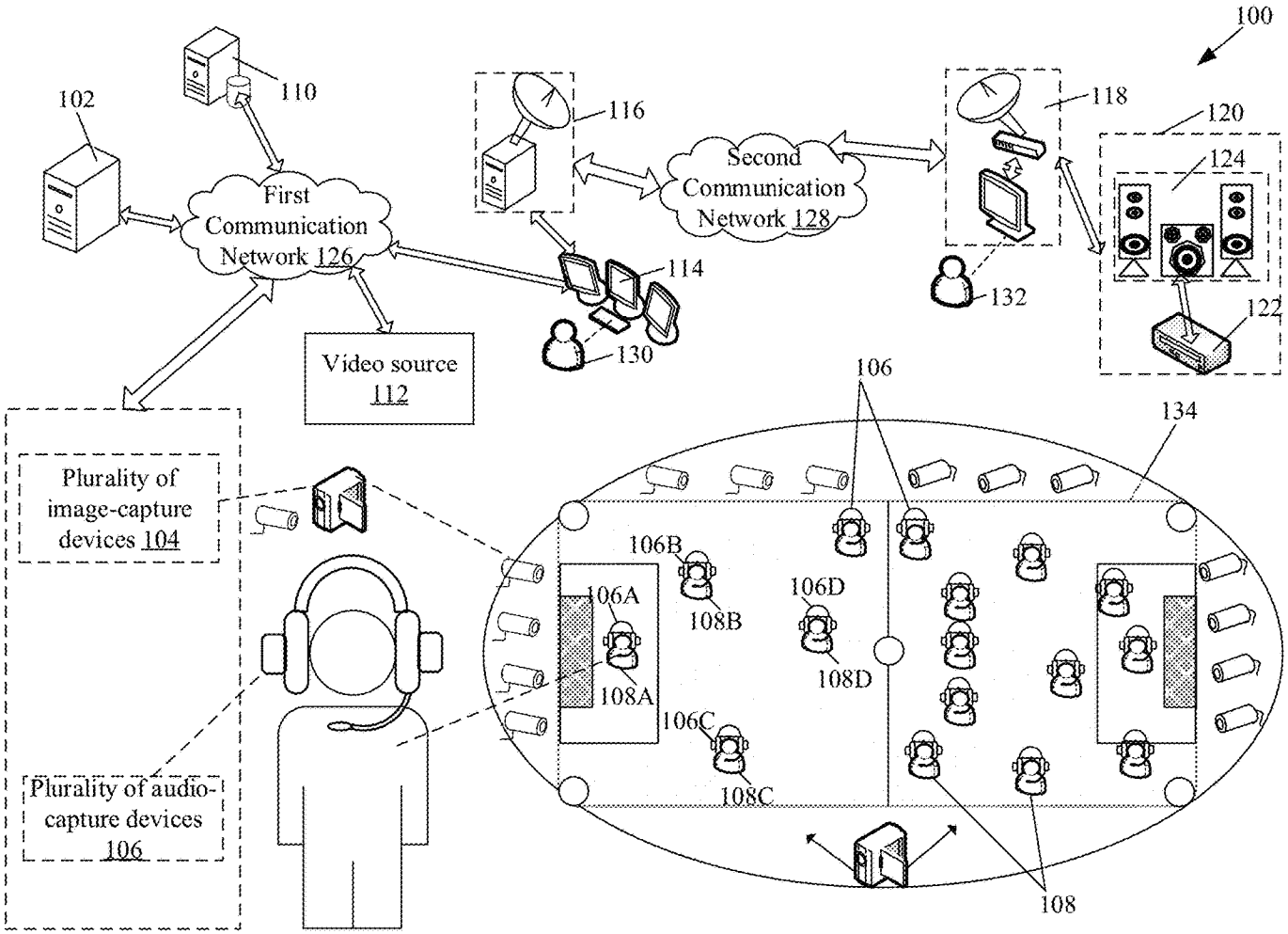
FIG. 1 illustrates an exemplary network environment for a media content packaging and distribution system for dynamic generation of multi-channel audio from the perspective of a specific user, in accordance with an embodiment of the disclosure.

The following described implementations may be found in the disclosed media content packaging and distribution system for dynamic generation of multi-channel audio from the perspective of a specific user. Exemplary aspects of the disclosure may include a system that may comprise a memory and a circuitry. The memory may be configured to store location information of a plurality of subjects located in a defined area. Audio from each subject of the plurality of subjects may be captured with at least one audio-capture device of a plurality of audio-capture devices. The plurality of audio-capture devices may be worn, for example, by the plurality of subjects in the defined area. The circuitry may be configured to select a subject-of-interest from the plurality of subjects in the defined area. The circuitry may be further configured to select a set of audio-capture devices from the plurality of audio-capture devices, based on a first location of the selected subject-of-interest.

The circuitry may be further configured to receive a set of audio streams from the selected set of audio-capture devices. The circuitry may be configured to generate a multi-channel audio based on the received set of audio streams, the first location of the subject-of-interest, and a set of locations of a set of subjects equipped with the selected set of audio-capture devices. The circuitry may be further configured to communicate the generated multi-channel audio to a consumer device. An acoustic environment within proximity of the subject-of-interest in the defined area may be reproduced as a surround sound environment at the consumer device from a perspective of the subject-of interest, based on an output of the multi-channel audio by the consumer device.

In accordance with an embodiment, the circuitry may be configured to predict the subject-of-interest from the plurality of subjects using a prediction system, based on historical performance information of each subject of the plurality of subjects. The circuitry may be further configured to monitor one or more social media platforms to determine a count of social media posts associated with each subject of the plurality of subjects. The subject-of-interest may be selected based on at least a highest count of social media posts associated with the subject-of-interest in comparison to other subjects of the plurality of subjects in the one or more social media platforms.

In accordance with an embodiment, the circuitry may be configured to receive a user-preference that corresponds to selection of the subject-of-interest from a consumer device communicatively coupled with the circuitry. The subject-of-interest may be selected based on the received user-preference from the consumer device. The circuitry may be configured to communicate a first control instruction to an image-capture device, communicatively coupled to the circuitry, to focus on a first subject in the defined area. The circuitry may be configured to select the first subject as the subject-of-interest. The circuitry may be further configured to determine the first location of the subject-of-interest based on a focal length of the image-capture device and an orientation of the image-capture device. The circuitry may be further configured to select the set of audio-capture devices associated with the set of subjects based on proximity of the set of audio-capture devices to the first location of the selected subject-of-interest. The circuitry may be further configured to receive location information of each audio-capture device from the plurality of audio-capture devices associated with the plurality of subjects. The location information of each audio-capture device may indicate a location of each subject of the plurality of subjects in the defined area.

In accordance with an embodiment, the circuitry may be configured to generate the multi-channel audio based on a relative position of each location of the set of locations with respect to the first location of the subject-of-interest. The circuitry may be configured to generate the multi-channel audio based on a relative elevation of each audio-capture device of the set of audio-capture devices with respect to the first audio-capture device of the subject-of-interest. The circuitry may be further configured to communicate the generated multi-channel audio to a multi-channel speaker system. A surround sound environment may be produced by the multi-channel speaker system from a perspective of the subject-of interest. The created surround sound environment from the perspective subject-of interest may be a simulation of an acoustic environment that surrounds the subject-of-interest in the defined area. The system may further comprise a multi-channel surround sound encoder. The circuitry may be configured to mix the received set of audio streams by the multi-channel surround sound encoder to generate the multi-channel audio. The circuitry may be configured to package the generated multi-channel audio with a first video to generate a media stream to be communicated to a consumer device. The first video may be received from a video source communicatively coupled to the circuitry. The circuitry may be configured to generate the multi-channel audio based on a head related transfer function.

FIG. 1 illustrates an exemplary network environment to generate a multi-channel audio from a perspective of a specific user, in accordance with an embodiment of the disclosure. With reference to FIG. 1, there is shown an exemplary network environment 100. The exemplary network environment 100 may include a server 102, a plurality of image-capture devices 104, and a plurality of audio-capture devices 106. Each of the plurality of audio-capture devices 106 may be associated with a subject of a plurality of subjects 108 present in a defined area 134. For example, a first audio-capture device 106A, a second audio-capture device 106B, a third audio-capture device 106C, and a fourth audio-capture device 106D of the plurality of audio-capture devices 106 may be associated with a first subject 108A, a second subject 108B, a third subject 108C, and a fourth subject 108D respectively. The exemplary network environment 100 may comprise a social media server 110, a video source 112, a broadcast-controller terminal 114, a media packaging and distribution apparatus 116, a consumer device 118, and a multi-channel speaker system 120. The multi-channel speaker system 120 may comprise an audio amplifier 122 and a plurality of speakers 124.

The exemplary network environment 100 may further comprise a first communication network 126 and a second communication network 128. The server 102, the social media server 110, the plurality of image-capture devices 104, the plurality of audio-capture devices 106, and the video source 112 may communicate with each other via the first communication network 126. The media packaging and distribution apparatus 116 and the consumer device 118 may communicate with each other via the second communication network 128. There is further shown a broadcast-controller user 130, who may operate the broadcast-controller terminal 114, and a consumer 132, who may use the consumer device 118. The plurality of audio-capture devices 106 and the plurality of image-capture devices 104 may be disposed in the defined area 134, for example a specified area within a stadium. One or more events, such as a sporting event or a musical event, may be conducted in the defined area 134.

The server 102 may refer to a centralized server comprising suitable logic, circuitry, interfaces, and/or code that may be configured to generate a multi-channel audio based on one or more audio streams captured by the plurality of audio-capture devices 106. In accordance with an embodiment, the server 102 may comprise suitable logic, circuitry, interfaces, and/or code that may correspond to a head related transfer function (HRTF). The server 102 may be configured to process the one or more audio streams with the HRTF to generate the multi-channel audio. The server 102 may be configured to store location information of each of the plurality of subjects 108 within the defined area 134. The server 102 may be configured to store information associated with elevation of each of the plurality of audio-capture devices 106 with respect to a common plane (for example, a ground-level of the defined area 134). The server 102 may be further configured to store information that includes physical height of each of the plurality of subjects 108. In certain scenarios, the elevation of an audio-capture device of the plurality of audio-capture devices 106 may be dependent on the physical height of a subject as the audio-capture device may be worn by the subject. Therefore, physical height of each of the plurality of subjects 108 with respect to each other may represent relative elevations of each of the plurality of audio-capture devices 106. Alternatively stated, the server 102 may be configured to store relative elevations of the plurality of audio-capture devices 106 with respect to each other.

In accordance with an embodiment, the server 102 may be configured to store statistical data associated with each of the plurality of subjects 108. The statistical data may include historical information (such as average scores, highest scores, ranks) associated with performance of each of the plurality of subjects 108 in one or more events, such as sporting events. The statistical data may further include information (such as current scores) associated with current performance and recent performances of each of the plurality of subjects 108, in the one or more events. For example, the statistical data of a subject of the plurality of subjects 108 may comprise information related to number of goals served by the subject in one or more soccer matches. Examples of the server 102 may include, but are not limited to an application server, a cloud server, a web server, a database server, a file server, a mainframe server, or any combination thereof.

The plurality of image-capture devices 104 may comprise suitable logic, circuitry, interfaces, and/or code that may be configured to capture video or an image of the one or more events that may occur in the defined area 134. In accordance with an embodiment, the plurality of image-capture devices 104 may correspond to networked-cameras, which may be connected wirelessly (or based on a wired connection) to the first communication network 126. In accordance with an embodiment, the plurality of image-capture devices 104 may also include human-controlled cameras, which may be controlled by personnel deployed in the vicinity of the defined area 134. The plurality of image-capture devices 104 may be configured to communicate with the server 102 and/or the broadcast-controller terminal 114, via the first communication network 126. For example, the plurality of image-capture devices 104 may be configured to transmit a plurality of video feeds that capture the plurality of subjects 108 and the defined area 134 to the server 102 or the broadcast-controller terminal 114, via the first communication network 126.

In accordance with an embodiment, each image-capture device of the plurality of image-capture devices 104 may be directed to focus towards a particular subject in the defined area 134, based on one or more control instructions communicated by the server 102. Alternatively, the one or more control instructions may be received from the broadcast-controller terminal 114 based on an input provided by the broadcast-controller user 130. Each of the plurality of image-capture devices 104 may comprise one or more sensors which may be configured to sense information associated with focal length and orientation of the respective image-capture device. Each of the plurality of image-capture devices 104 may be configured to communicate information associated with focal lengths and orientations of the respective image-capture devices to the server 102. In some embodiments, each of the plurality of image-capture devices 104 may comprise a location sensor, such as a GPS sensor, to sense a location of the respective image-capture device. Examples of implementation of each of the plurality of image-capture devices 104 may include, but are not limited to, an image-sensor, a spider camera, an on-field camera, a drone-camera, a 360 degree camera, and/or a wide-angle camera.

Each of the plurality of audio-capture devices 106 may comprise suitable logic, circuitry, interfaces, and/or code that may be configured to capture sound in their vicinity in the defined area 134. The plurality of audio-capture devices 106 may be configured to convert the captured audio to the plurality of audio streams. Examples of audio formats in which the plurality of audio streams may be formatted may include, but are not limited to a waveform audio file format (WAV), and audio interchange file format (AIFF), and pulse code modulation (PCM) based audio stream format. The plurality of audio-capture devices 106 may be configured to communicate the plurality of audio streams to the server 102.

Each of the plurality of audio-capture devices 106, worn by a subject, may comprise a global positioning system (GPS) sensor to detect locations of the respective subject. In accordance with an embodiment, the plurality of audio-capture devices 106 may correspond to networked-microphones, which may be connected wirelessly (or based on a wired connection) to the first communication network 126.

The plurality of audio-capture devices 106 may be configured to communicate with the server 102 and/or the broadcast-controller terminal 114, via the first communication network 126. For example, the plurality of audio-capture devices 106 may be configured to transmit a plurality of audio streams captured from the defined area 134, to the server 102, and/or the broadcast-controller terminal 114, via the first communication network 126. In accordance with an embodiment, each of the plurality of audio-capture devices 106 may comprise a magnetometer to sense an orientation of the respective audio-capture device. Examples of implementation of each of the plurality of audio-capture devices 106 may include, but are not limited to, a shotgun microphone, a lapel microphone, a handheld microphone, a smartphone, a wireless microphone, and/or an omnidirectional microphone. In some embodiments, one or more of the plurality of audio-capture devices 106 may refer to integrated microphones of portable electronic devices, such as a smart watch, a smart phone, a helmet, a smart band, and/or a lapel embedded in a dress/uniform, or accessories worn by the plurality of subjects 108.

The social media server 110 may comprise suitable logic, circuitry, interfaces, and/or code that may be configured to store a plurality of social media posts associated with a plurality of users (such as consumers) of one or more social media platforms. The social media server 110 may be configured to be updated periodically with new social media posts from the plurality of users, in real time or near-real time. The server 102 may be configured to access or read the plurality of social media posts stored at the social media server 110. Examples of implementation of the social media server 110 may include, but are not limited to, an application server, a cloud server, a web server, a database server, a file server, a mainframe server, or any combination thereof.

The video source 112 may comprise suitable logic, circuitry, interfaces, and/or code that may be configured to store one or more videos. The stored one or more videos may be accessible by the server 102 and the broadcast-controller terminal 114. In accordance with an embodiment, the video source 112 may receive one or more video feeds or images from the plurality of image-capture devices 104 and may be configured to communicate the received video feeds or images to the server 102. The video source 112 may be a video server, examples of which may include, but are not limited to a cloud server, a web server, a database server, a file server, a mainframe server, or any combination thereof.

The broadcast-controller terminal 114 may comprise suitable logic, circuitry, interfaces, and/or code that may be configured to control live broadcast of the generated multi-channel audio to consumer devices (such as the consumer device 118). In accordance with an embodiment, the broadcast-controller terminal 114 may be configured to receive the one or more videos from the video source 112 and/or the server 102. The broadcast-controller terminal 114 may be configured to control the live broadcast of the received videos to the consumer device 118.

The broadcast-controller terminal 114 may be configured to present a control interface to the broadcast-controller user 130. The broadcast-controller user 130 may control the live broadcast by use of the presented control interface. The presented control interface may be physical (for example a touch screen display and/or a keyboard) or virtual (for example, an application interface for a control application that controls the live broadcast). In accordance with an embodiment, the broadcast-controller terminal 114 may be configured to receive the generated multi-channel audio from the server 102, by use of the first communication network 126. The broadcast-controller terminal 114 may also be configured to receive a plurality of audio streams captured by the plurality of audio-capture devices 106. The plurality of audio streams and the generated multi-channel audio may be communicated by the broadcast-controller terminal 114 to the media packaging and distribution apparatus 116. The plurality of audio streams and the generated multi-channel audio may then be communicated (for example, a live unicast or multicast) by the media packaging and distribution apparatus 116 to the consumer device 118 of the consumer 132, via the second communication network 128.

The media packaging and distribution apparatus 116 may comprise suitable logic, circuitry, interfaces, and/or code that may be configured to perform the live distribution of media content (such as the generated multi-channel audio and the plurality of audio streams), to various consumer devices, (such as, the consumer device 118) via the second communication network 128. In accordance with an embodiment, the media packaging and distribution apparatus 116 may include a communication circuit that may be configured to perform the distribution of the generated multi-channel audio to a plurality of consumer devices (such as the consumer device 118) of respective consumers (such as the consumer 132).

The consumer device 118 may comprise suitable logic, circuitry, interfaces, and/or code that may be configured to receive the media content (such as the generated multichannel audio) from the media packaging and distribution apparatus 116. The consumer device 118 may be further configured to output video of the received media content on a display screen of the consumer device 118 and the multi-channel audio via the multi-channel speaker system 120. In accordance with an embodiment, the consumer device 118 may be installed on the premises (residential or official) of the consumer 132. The consumer 132 may be required to subscribe with a service provider of the consumer device 118 to access or use the consumer device 118. A person with ordinary skill in the art may understand that though the consumer device 118 has been illustrated as a television with a set-top-box and overhead-dish, the scope of the disclosure should not be limited to this illustrative example. Examples of implementation of the consumer device 118 may include, but is not limited to a smart phone, a wearable electronic device, a tablet computer, a laptop, a desktop/personal computer, an outdoor-media screen, and/or an advertisement screen.

The multi-channel speaker system 120 may comprise suitable logic, circuitry, interfaces, and/or code that may be configured to play the generated multi-channel audio to the consumer 132 via the plurality of speakers 124 suitably positioned around the consumer 132, to simulate a surround sound environment around the consumer 132. The multi-channel speaker system 120 may further comprise the audio amplifier 122, which may be configured to decode the generated multi-channel audio and control output of the multi-channel audio through the plurality of speakers 124. In one example, the plurality of speakers 124 may comprise a left speaker, a center speaker, a right speaker, a top speaker, and a bottom speaker. Examples of the plurality of speakers 124 may include, but are not limited to woofer speakers, sub-woofer speakers, bass speakers, treble speakers, and tweeter speakers. Examples of the implementation of the multi-channel speaker system 120 may include, but is not limited to a home theater system or a car stereo system.

The first communication network 126 may include one or more mediums through which various devices (such as the server 102, the social media server 110, and the broadcast-controller terminal 114) may communicate with each other. The first communication network 126 may also include a medium through which the server 102 may communicate with the plurality of audio-capture devices 106. Examples, of the first communication device may include, but is not limited to the Internet, a cloud network, a Wireless Fidelity (Wi-Fi) network, a Personal Area Network (PAN), a Local Area Network (LAN), and/or a Metropolitan Area Network (MAN). Various devices (such as the server 102, the social media server 110, and the broadcast-controller terminal 114) in the exemplary network environment 100 may be configured to connect to the first communication network 126, in accordance with various wired and wireless communication protocols. Examples of such wired and wireless communication protocols may include, but are not limited to, at least one of a Transmission Control Protocol and Internet Protocol (TCP/IP), User Datagram Protocol (UDP), Hypertext Transfer Protocol (HTTP), File Transfer Protocol (FTP), ZigBee, EDGE, IEEE 802.11, IEEE 802.11b, IEEE 802.11g, IEEE 802.11n, and/or any other IEEE 802.11 protocol, multi-hop communication, wireless access point (AP), device to device communication, cellular communication protocols, Light-fidelity (Li-Fi), Internet-of-Things (IoT) network, or Bluetooth (BT) communication protocols, or a combination or variants thereof. In certain scenarios, the first communication network 126 may be via an internet of things (IoT) based communication network. A person having ordinary skill in the art may understand that the scope of the disclosure should not be limited to the use of IoT based communication. Any other communication medium that may enable fast real-time communication between devices may also be used.

The second communication network 128 may include one or more mediums through which various devices (such as the media packaging and distribution apparatus 116 and the consumer device 118) may communicate with each other. Examples of the second communication network 128 may include, but is not limited to, the Internet, a cloud network, a Wireless Fidelity (Wi-Fi) network, a Personal Area Network (PAN), a Local Area Network (LAN), and/or a Metropolitan Area Network (MAN). Various devices (such as the media packaging and distribution apparatus 116, and the consumer device 118) in the exemplary network environment 100 may be configured to connect to the second communication network 128, in accordance with various wired and wireless communication protocols. Examples of such wired and wireless communication protocols may include, but are not limited to, at least one of a Transmission Control Protocol and Internet Protocol (TCP/IP), User Datagram Protocol (UDP), Hypertext Transfer Protocol (HTTP), File Transfer Protocol (FTP), ZigBee, EDGE, IEEE 802.11, IEEE 802.11b, IEEE 802.11g, IEEE 802.11n, and/or any other IEEE 802.11 protocol, multi-hop communication, wireless access point (AP), device to device communication, cellular communication protocols, Light-fidelity (Li-Fi), Internet-of-Things (IoT) network, or Bluetooth (BT) communication protocols, or a combination or variants thereof. Examples of other implementations of the second communication network 128 may include, but is not limited to terrestrial TV network, cable TV network, Internet TV, interactive TV (iTV) network, Satellite TV, and/or direct-to-home (DTH) TV network.

The defined area 134 may be a specified area of a stadium, a building, or certain geographical area in which one or more events (such as sports events or drama events) may be organized. The plurality of image-capture devices 104, the plurality of audio-capture devices 106, and the plurality of subjects 108 may be located in the defined area 134. The defined area 134 may be an indoor or an outdoor area. In certain scenarios, the defined area 134 may correspond to a sports ground at which one or more sports events may be organized. In one example, the sports ground may host a football match between two teams. The plurality of subjects 108 may participate in the sports event as players of the sports event. In another example, the defined area 134 may correspond to a theatrical stage at which one or more drama based events or musical events may be organized.

In operation, the server 102 may be configured to determine locations of each of the plurality of subjects 108 by use of the plurality of audio-capture devices 106. In some embodiments, at least one audio-capture device of the plurality of audio-capture devices 106 may be worn by each subject of the plurality of subjects 108. The plurality of audio-capture devices 106 may be positioned at different subjects of the plurality of subjects 108, to capture audio in proximity of the respective subjects. For example, an audio-capture device may be disposed near the head of the respective subject (for example, as an earpiece microphone) and may capture audio that corresponds to sound that the respective subject may hear in the defined area 134. The captured audio may comprise words spoken by the respective subject and ambient sound in proximity of the respective subject. Each of the plurality of audio-capture devices 106 may include a location sensor (such as the GPS sensor). The plurality of audio-capture devices 106 may determine locations of the plurality of subjects 108 by use of the location sensors. The plurality of audio-capture devices 106 may be configured to communicate the determined locations of the plurality of subjects 108 to the server 102.

In some embodiments, the server 102 may be configured to determine locations of each of the plurality of subjects 108 by use of the plurality of image-capture devices 104. For example, an image-capture device (of the plurality of image-capture devices 104) may be focused on a particular subject (of the plurality of subjects 108) positioned within the defined area 134. In such a case, the one or more sensors in the image-capture device may be configured to sense a focal length and orientation of the image-capture device. The sensed focal length and the orientation of the image-capture device may correspond to a relative position of the particular subject with respect to the image-capture device. The relative position of the particular subject with respect to the image-capture device may correspond to a position vector originating from the image-capture device to the particular subject. In such a case, the sensed focal length may correspond to magnitude of the position vector (i.e., a distance of the particular subject from the image-capture device) and the sensed orientation may correspond to direction of the position vector (with respect to the specified geographic coordinate system). The image-capture device may be further configured to sense location of the image-capture device by use of the location sensor (such as the GPS sensor) integrated within the image-capture device. The image-capture device may be configured to communicate information associated with the sensed focal length, the orientation, and the location of the image-capture device to the server 102.

The server 102 may be configured to compute a relative position of the particular subject with respect to the image-capture device, based on the focal length, the orientation, and the location of the image-capture device. The server 102 may be further configured to compute a first location of the particular subject, based on the computed relative position of the particular subject and the location of the image-capture device, by use of coordinate geometry. Information associated with locations of the plurality of subjects 108 is hereafter referred to as location information.

In accordance with an embodiment, the server 102 may be configured to store location information (of the plurality of subjects 108) and elevation (of the plurality of audio-capture devices 106 with respect to ground level of the defined area 134) in a tabulated format. An example is illustrated as TABLE 1.

TABLE 1

Exemplary location information associated with one or more subjects

| Subject_name | Location_Coordinates (X, Y) | Elevation (Cm) |
|---|---|---|
| George (First subject 108A) | 10, 30 | 172 |
| William (Second subject 108B) | 15, 18 | 158 |
| Ryan (Third subject 108C) | 20, 29 | 166 |
| Paul (Fourth subject 108D) | 29, 85 | 159 |

In accordance with an embodiment, the server 102 may be configured to select a subject-of-interest from the plurality of subjects 108 in the defined area 134. The server 102 may be configured to select the subject-of-interest based on a plurality of weight values assigned to each of the plurality of subjects 108. In one example, the plurality of weight values associated with a subject may indicate a probability to be designated as the subject-of-interest. The server 102 may be configured to assign the plurality of weight values to each of the plurality of subjects 108, based on one or more parameters (such as social media trends associated with the respective subject, historical performance information associated with the respective subject, and user preferences of the consumer 132, which may have been received at the server 102 from the consumer device 118). The plurality of weight values may comprise a first weight value W(i), a second weight value X(i), a third weight value Y(i), and a fourth weight value Z(i).

In accordance with an embodiment, the server 102 may be configured to monitor the plurality of social media posts stored in the social media server 110, to assign the first weight value W(i) to subjects of the plurality of subjects 108. The server 102 may be configured to identify one or more social media posts (of the plurality of social media posts) which may be associated with one or more subjects of the plurality of subjects 108. The server 102 may be configured to determine social media activity level, such as a count of social media posts, associated with each subject of the plurality of subjects 108. In cases where a count of the social media posts associated with a particular subject crosses a defined numerical threshold, the server 102 may be configured to identify the respective subject to be a trending person in the one or more social media platforms. In such a case, the server 102 may be configured to select the respective subject as the subject-of-interest.

In accordance with an embodiment, the server 102 may be configured to select a subject of the plurality of subjects 108 as the subject-of interest based on a highest count of social media posts associated with the subject, in comparison to other subjects of the plurality of subjects 108. In accordance with an embodiment, the server 102 may be configured to assign each of the plurality of subjects 108 with the first weight value W(i) based on the count of social media posts associated with the respective subject. In certain scenarios, a larger count of social media posts may be associated with a first subject 108A, in comparison to a second subject 108B. In such cases the first weight value W(i) assigned for the first subject 108A, by the server 102, may be larger in comparison to the first weight value W(i) assigned for the second subject 108B.

In accordance with an embodiment, the server 102 may be configured to monitor historical performance information associated with each of the plurality of subjects 108. The server 102 may be configured to predict a subject of the plurality of subjects 108 to be a subject-of-interest, based on the historical performance information associated with the subject. For example, the historical performance information of each subject may comprise a count of goals scored by the respective subject in a first set of football matches played by the subject. In certain scenarios, a subject of the plurality of subjects 108 may have scored a highest count of goals in comparison to other subjects of the plurality of subjects 108. In such cases, the server 102 may be configured to select the subject as the subject-of-interest. In another example, a first subject 108A (of the plurality of subjects 108) may have scored a higher count of goals, in comparison to the second subject 108B. In such a case, the second weight value X(i) assigned for the first subject 108A by the server 102 may be greater in comparison to the second weight value X(i) assigned for the second subject 108B.

In accordance with an embodiment, a user-preference that corresponds to a selection of the subject-of-interest may be received from the consumer device 118 by the server 102. In certain scenarios, the server 102 may be configured to monitor user inputs received from the consumer 132 via the consumer device 118 to assign the third weight value Y(i) to each of the plurality of subjects 108. In other scenarios, the server 102 may be configured to monitor user inputs received from the broadcast-controller user 130 via the broadcast-controller terminal 114 to assign the third weight value Y(i) to each of the plurality of subjects 108. In one example, the server 102 may be configured to monitor one or more user interactions performed by the broadcast-controller user 130 on a control interface of the broadcast-controller terminal 114. In another example, the server 102 may be configured to monitor one or more user interactions performed by the consumer 132 on a user control interface of the consumer device 118.

The one or more user interaction may correspond to selection of a subject from the plurality of subjects 108 for the purpose of designating the respective subject as the subject-of-interest. Alternatively stated, the server 102 may be configured to receive selection of the subject from the plurality of subjects 108 from the broadcast-controller user 130 and/or the consumer 132. In certain scenarios, the server 102 may be configured to receive votes from a plurality of users (such as the consumer 132) to select different subjects of the plurality of subjects 108, as the subject-of-interest. In such a scenario, the server 102 may be configured to assign the third weight value Y(i) to each subject, based on a number of votes received for each subject of the plurality of subjects 108.

In accordance with an embodiment, one or more of the plurality of image-capture devices 104 may be focused on one or more subjects of the plurality of subjects 108. In such scenarios, the server 102 may be configured to assign the fourth weight value Z(i) to the one or more subjects of the plurality of subjects 108. In accordance with an embodiment, the server 102 may be configured to communicate a first control instruction to the one or more image-capture devices, to focus on the first subject 108A in the defined area 134. The one or more image-capture devices may be configured to receive the first control instruction and subsequently focus on the first subject 108A. In such a case, the server 102 may be configured to select the first subject 108A as a subject-of-interest.

The server 102 may be configured to store the first weight value W(i), the second weight value X(i), the third weight value Y(i), and the fourth weight value Z(i) associated with each of the plurality of subjects 108. Further, the server 102 may be configured to calculate a weight sum T(i) by summation of the first weight value W(i), the second weight value X(i), the third weight value Y(i), and the fourth weight value Z(i) associated with each of the plurality of subjects 108. The server 102 may be configured to rank the plurality of subjects 108 based on weight sum T(i). In one example, the server 102 may be configured to tabulate the weight sum T(i) associated with each of the plurality of subjects 108. An example is illustrated in Table 2.

TABLE 2

Weight values associated with one or more subjects.

| Subject_name | Assigned_weight_values (W(i), X(i), Y(i), Z(i)) | Sum_of_weight_values T(i) |
|---|---|---|
| George (The first subject 108A) | 5, 7, 6, 9 | 27 |
| William (The second subject 108B) | 4, 1, 2, 2 | 9 |
| Ryan (The third subject 108C) | 2, 2, 2, 1 | 7 |
| Paul (The fourth subject 108D) | 1, 1, 1, 1 | 4 |

In accordance with an embodiment, the server 102 may be configured to select a subject from the plurality of subjects 108, as a subject-of-interest, based on a weight sum T(i) calculated for each subject. The server 102 may be configured to select the subject-of-interest based on highest value of the weight sums T(i) of the respective subject in comparison with other subjects of the plurality of subjects 108. For example, a weight sum T(1) of the first subject 108A may be greater than weight sums T(2), T(3), and T(4), of the second subject 108B, the third subject 108C, and the fourth subject 108D respectively. In such a case, the server 102 may select the first subject 108A as the subject-of-interest.

In some embodiments, the server 102 may be configured to select a set of audio-capture devices from the plurality of audio-capture devices 106, based on a first location of the selected subject-of-interest. For example, the selected set of audio-capture devices may be located within vicinity of the first location of the selected subject-of-interest. In certain scenarios, the server 102 may be configured to select the set of audio-capture devices based on the plurality of weight values assigned to a set of subjects (which may be associated with the set of audio-capture devices). For example, the set of subjects may have at least one of the weight values (e.g. W(i), X(i), Y(i), Z(i), and T(i)) greater than a user-defined or particular threshold weight value. In such a case, the server 102 may be configured to select the set of audio-capture devices associated with the set of subjects. The set of audio-capture devices may comprise the first audio-capture device 106A, the second audio-capture device 106B, the third audio-capture device 106C, and the fourth audio-capture device 106D. Further, the set of subjects may comprise the first subject 108A, the second subject 108B, the third subject 108C, and the fourth subject 108D.

The selected set of audio-capture devices may be configured to capture audio from the set of subjects (who may be associated with the selected set of audio-capture devices).

The audio may be captured by the selected set of audio-capture devices (which may comprise the first audio-capture device 106A, the second audio-capture device 106B, the third audio-capture device 106C, and the fourth audio-capture device 106D). The server 102 may be configured to receive a set of audio streams (associated with the captured audio) from the selected set of audio-capture devices.

In accordance with an embodiment, the server 102 may be configured to generate the multi-channel audio from the set of audio streams. The server may be configured to generate the multi-channel audio based on the first location of the subject-of-interest and a set of locations of the set of audio-capture devices. In accordance with an embodiment, the server 102 may be configured to mix the received set of audio streams with a multi-channel surround sound encoder to generate the multi-channel audio. In other embodiments, the server 102 may be configured to generate the multi-channel audio by use of the HTRF. The generation of multi-channel audio is described in detail, for example, in FIGS. 3 and 4. In other scenarios, the server 102 may be configured to assign each of the set of audio streams to one or more of a plurality of audio channels (such as a right channel, and a left channel) in the multi-channel audio. The server 102 may be configured to subsequently encode each of the set of audio streams into the one or more audio channels, based on the assignment. Each of the plurality of audio channels may correspond to one or more speakers in the multi-channel speaker system 120.

In accordance with an embodiment, the server 102 may be configured to receive a first video from the video source 112. The server 102 may be configured to package the first video with the generated multi-channel audio to generate a media stream. In accordance with an embodiment, the server 102 may be configured to communicate the generated media stream to consumer device 118, by use of the media packaging and distribution apparatus 116.

In accordance with an embodiment, the server 102 may be configured to communicate the generated multi-channel audio to the consumer device 118. The consumer device 118 may be configured to generate a surround sound environment around the consumer 132, based on an output of the multi-channel audio by the consumer device 118. The surround sound environment may correspond to an acoustic environment in the proximity of the subject-of-interest in the defined area 134, from a perspective of the subject-of interest.

Figure 2:
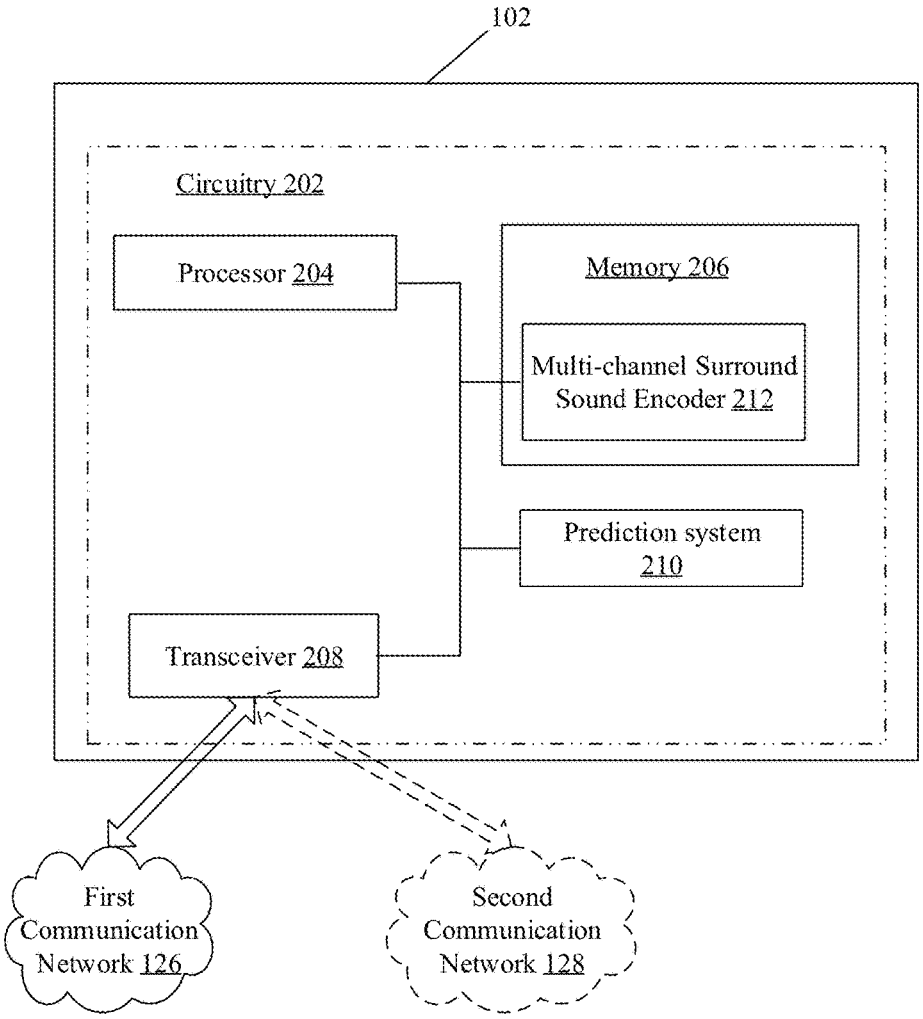
FIG. 2 is a block diagram that illustrates an exemplary server for dynamic generation of multi-channel audio from a perspective of a specific user, in accordance with an embodiment of the disclosure.

FIG. 2 is a block diagram that illustrates an exemplary server to provision a media content packaging and distribution system for dynamic generation of multi-channel audio from a perspective of a specific user, in accordance with an embodiment of the disclosure. FIG. 2 is explained in conjunction with elements from FIG. 1. With reference to FIG. 2, there is shown the server 102. The server 102 may comprise a circuitry 202. The circuitry 202 may comprise a processor 204, a memory 206, and a transceiver 208. There is also shown the first communication network 126 and the second communication network 128. The memory 206 may comprise a prediction system 210, and a multi-channel surround sound encoder 212.

In accordance with an embodiment, the server 102 may be communicatively coupled to one or more other electronic devices or servers, through the first communication network 126, and/or the second communication network 128, via the transceiver 208. The processor 204 may be communicatively coupled to the memory 206 and the transceiver 208, via a system bus. In accordance with an embodiment, the server 102 may be an electronic device that may include one or more logic, circuitry, and/or code configured to generate the multi-channel audio.

The processor 204 may comprise suitable logic, circuitry, interfaces, and/or code that may be configured to execute a set of instructions stored in the memory 206. The processor 204 may be configured to execute a set of instructions stored by use of the prediction system 210, and the multi-channel surround sound encoder 212 installed in the memory 206. Examples of implementation of the circuitry 202 may be an X86-based processor, a Reduced Instruction Set Computing (RISC) processor, an Application-Specific Integrated Circuit (ASIC) processor, a Complex Instruction Set Computing (CISC) processor, and/or other processors.

The memory 206 may comprise suitable logic, circuitry, and/or interfaces that may be configured to store a set of instructions executable by the processor 204. The memory 206 may be further configured to store the plurality of audio streams received from the plurality of audio-capture devices 106. The memory 206 may be configured to store locations and relative elevations of each of the plurality of audio-capture devices 106 (as discussed in FIG. 1). The memory 206 may further comprise suitable logic, interfaces, and/or code that may be correspond to the prediction system 210, may be configured to predict a subject among the plurality of subjects 108 as a subject-of-interest. For example, the prediction system 210 may be implemented as a set of instructions stored in the memory 206, which upon execution by the processor 204 may perform the functions of the prediction system 210. The memory 206 may further comprise suitable logic, interfaces, and/or code that may correspond to the multi-channel surround sound encoder 212, which may be configured to encode the plurality of audio streams into the multi-channel audio. The memory 206 may be further configured to store statistical data (historical performance information) of each of the plurality of subjects 108. Examples of implementation of the memory 206 may include, but not limited to, Random Access Memory (RAM), Read Only Memory (ROM), Hard Disk Drive (HDD), a Secure Digital (SD) card, and/or other Solid State Device (SSD).

In accordance with an embodiment, the multi-channel surround sound encoder 212 may comprise suitable logic, and/or code that may be configured to generate the multi-channel audio. In accordance with an embodiment, the multi-channel surround sound encoder 212 may be a part of the processor 204. Alternatively, the multi-channel surround sound encoder 212 may be implemented as a separate processor or circuitry in the server 102. In accordance with an embodiment, the multi-channel surround sound encoder 212 and the processor 204 may be implemented as an integrated processor or a cluster of processors that perform the functions of the multi-channel surround sound encoder 212 and the processor 204.

In accordance with an embodiment, the prediction system 210 may comprise suitable logic, circuitry, interfaces, and/or code that may be configured to predict a subject among the plurality of subjects 108 as a subject-of-interest. The prediction system 210 may be configured to monitor the statistical data, to predict the subject-of-interest based on the monitored statistical data. In accordance with an embodiment, the prediction system 210 may be a part of the processor 204. Alternatively, the prediction system 210 may be implemented as a separate processor or circuitry in the server 102. In accordance with an embodiment, the prediction system 210 and the processor 204 may be implemented as an integrated processor or a cluster of processors that perform the functions of the prediction system 210 and the processor 204.

The transceiver 208 may comprise suitable logic, circuitry, interfaces, and/or code that may be configured to communicate with other electronic devices (such as the social media server 110, the video source 112, and the plurality of audio-capture devices 106), via the first communication network 126. The transceiver 208 may implement known technologies to support wireless communication. The transceiver 208 may include, but are not limited to an antenna, a radio frequency (RF) transceiver, one or more amplifiers, a tuner, one or more oscillators, a digital signal processor, a coder-decoder (CODEC) chipset, a subscriber identity module (SIM) card, and/or a local buffer. The transceiver 208 may be configured to communicate via offline and online wireless communication with networks, such as the Internet, an Intranet, and/or a wireless network, such as a cellular telephone network, a wireless local area network (WLAN) and/or a metropolitan area network (MAN). The wireless communication may use any of a plurality of communication standards, protocols and technologies, such as Global System for Mobile Communications (GSM), Enhanced Data GSM Environment (EDGE), wideband code division multiple access (W-CDMA), code division multiple access (CDMA), LTE, time division multiple access (TDMA), Bluetooth, Wireless Fidelity (Wi-Fi) (such as IEEE 802.11, IEEE 802.11b, IEEE 802.11g, IEEE 802.11n, and/or any other IEEE 802.11 protocol), voice over Internet Protocol (VoIP), Wi-MAX, Internet-of-Things (IoT) technology, Machine-Type-Communication (MTC) technology, a protocol for email, instant messaging, and/or Short Message Service (SMS).

In operation, the processor 204 may be configured to assign the set of captured audio streams to the plurality of audio channels, based on the first location of the subject-of-interest and the set of locations of the set of audio-capture devices. The first location and the set of locations may be received by the transceiver 208 from the plurality of audio-capture devices 106, via the first communication network 126. Further, the first location and the set of locations may be stored at the memory 206. In certain scenarios, the processor 204 may be configured to assign the set of captured audio streams to the plurality of audio channels, based on relative positions of each of the set of audio-capture devices, with respect to the subject-of-interest. Further, the processor 204 may be configured to generate the multi-channel audio by use of the multi-channel surround sound encoder 212 based on a relative position of each subject with respect to the first location of the subject-of-interest. The relative position of each subject corresponds to the set of locations.

The processor 204 may be configured to determine the relative positions, based on a set of position vectors between each of the set of subjects and the subject-of-interest. The set of position vectors may be calculated by the processor 204 by use of coordinate geometry and locations of the subject-of-interest and the selected set of audio-capture devices in the vicinity of the subject-of-interest. For example, the first subject 108A may be the subject-of-interest, and the second subject 108B may be near to the first subject 108A. In such scenarios, the processor 204 may be configured to calculate a position vector from location of the first subject 108A to location of the second subject 108B. The position vectors include directional components and distance components. In one example, the processor 204 may extract the directional components and the distance components from the set of position vectors. The processor 204 may be configured to generate the multi-channel audio based on the extracted directional components of the position vectors in the set of position vectors. For example, the processor 204 may be configured to designate each of the set of audio streams into the plurality of audio channels based on the extracted directional components of the set of position vector.

Similarly, the processor 204 may be configured to attenuate one or more of the received set of audio streams based on the extracted directional components of the set of position vectors. For example, a distance component of a second position vector associated with the second subject 108B may be greater than a distance component of a third position vector associated with the third subject 108C. In such scenarios, the server 102 may be configured to attenuate the second audio stream of the second subject 1086 to a greater degree than a third audio stream captured by the third audio-capture device 106C of the third subject 108C.

In some other embodiments, the processor 204 may be configured to assign the set of audio-streams to the plurality of audio channels, based on an orientation of the subject-of-interest. In certain scenarios, the subject-of-interest (who may be wearing an audio-capture device) may be oriented towards a defined or particular direction (e.g. north, east, west, or south). In such scenarios, the direction or orientation of the subject-of-interest may be sensed by a magnetometer in the audio-capture device (which may be worn by the subject-of-interest). In one example, the subject-of-interest (positioned at the first location) may be oriented towards a first direction (such as north). In this case, the second location of the second subject 1086 may be relatively positioned towards right of the subject-of-interest. In such a case, the server 102 may be configured to designate a second audio stream from the second subject 108B (i.e. audio stream captured by the second audio-capture device 106B), to a right audio channel. Hence, when the multi-channel system plays the generated multi-channel audio, the second audio stream may be output from a speaker in the multi-channel speaker system 120 positioned towards the right of the consumer 132 to increase realism.

However, in some cases, the subject-of-interest may change orientation from the first direction towards a second direction (for example, south), and thereby alter the relative position of the second subject 108B with respect to the first location (for example, after the change in the orientation of the subject-of-interest, the second subject 108B may be located towards left of the subject-of-interest). In such a case, the server 102 may be configured to dynamically reassign the second audio stream to a left audio channel of the plurality of audio channels. Hence, when the multi-channel system plays the generated multi-channel audio, the second audio stream may be output from a speaker in the multi-channel speaker system 120 positioned towards the left of the consumer 132. Therefore, the consumer 132 may be able to sense the second audio stream to be emanating from left side of the consumer 132.

In accordance with one embodiment, the processor 204 may further be configured to calculate relative elevations of each of the set of audio-capture devices with respect to an audio-capture device associated with the subject-of-interest. In accordance with an embodiment, the server 102 may be configured to generate the multi-channel audio based on the relative elevations of each of the selected set of audio-capture devices, with respect to the audio-capture device of the subject-of-interest. Thereafter, the processor 204 may be configured to designate audio channels to the set of audio streams, based on the relative elevations. In one example, the subject-of-interest may be the first subject 108A and the audio-capture device associated with the first subject 108A may be the first audio-capture device 106A. In such cases, the processor 204 may be configured to generate the multi-channel audio (by use of the multi-channel surround sound encoder 212), based on a relative elevation of each audio-capture device of the selected set of audio-capture devices, with respect to the first audio-capture device 106A of the subject-of-interest (the first subject 108A).

In another example, the relative elevation of the second audio-capture device 106B of the second subject 108B may be higher with respect to the audio-capture device of the subject-of-interest. In such a case, the processor 204 may be configured to designate the second audio stream to a top audio channel among the plurality of audio channels. The top audio channel may be associated with a speaker in the multi-channel speaker system 120 positioned above the consumer 132. Thus, when the generated multi-channel audio is communicated to the multi-channel speaker, then the second audio stream encoded as the top audio channel may be output from a speaker in the multi-channel speaker system 120, positioned above the consumer 132 for enhanced realism.

Figure 3:
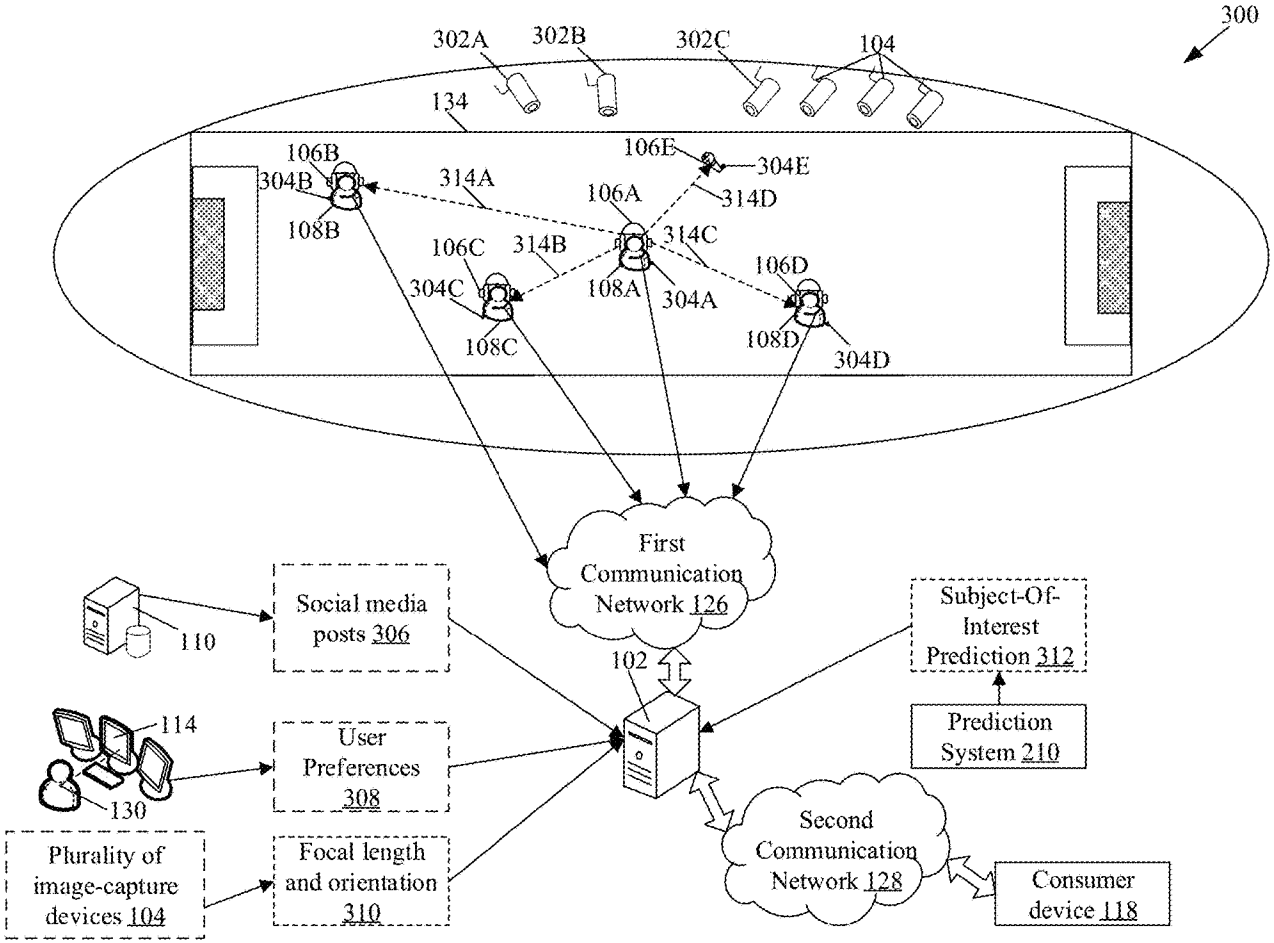
FIG. 3 illustrates a first exemplary scenario for implementation of the disclosed media content packaging and distribution system for dynamic generation of multi-channel audio from the perspective of a specific user, in accordance with an embodiment of the disclosure.

FIG. 3 illustrates an exemplary scenario for implementation of the disclosed system and method for packaging and distribution of media content for dynamic generation of multi-channel audio from the perspective of a specific user, in accordance with an embodiment of the disclosure. FIG. 3 is explained in conjunction with elements from FIGS. 1, and 2. With reference to FIG. 3, there is shown an exemplary scenario 300. The exemplary scenario 300 may comprise the server 102, the plurality of image-capture devices 104, the social media server 110, the broadcast-controller terminal 114, the first communication network 126, the second communication network 128, and the consumer device 118. The plurality of image capture-devices may comprise a first image-capture device 302A, a second image-capture device 302B, and a third image-capture device 302C. The exemplary scenario 300 illustrate the first audio-capture device 106A, the second audio-capture device 106B, the third audio-capture device 106C, the fourth audio-capture device 106D and a fifth audio-capture device 106E. The exemplary scenario 300 further illustrates the first subject 108A, the second subject 108B, the third subject 108C, and the fourth subject 108D. The first audio-capture device 106A, the second audio-capture device 106B, the third audio-capture device 106C, and the fourth audio-capture device 106D may be associated with the first subject 108A, the second subject 108B, the third subject 108C, and the fourth subject 108D respectively.

In the exemplary scenario 300, the first subject 108A, the second subject 108B, the third subject 108C, and the fourth subject 108D may be located at a first location 304A, a second location 304B, a third location 304C, and a fourth location 304D, as shown. Locations of the first subject 108A, the second subject 108B, the third subject 108C, and the fourth subject 108D may be determined by the associated audio-capture devices, as discussed in FIG. 1. The fifth audio-capture device 106E may be placed at sport equipment at a fifth location 304E. The location information of different subjects wearing the audio-capture devices may be communicated to the server 102. The memory 206 may be configured to store information associated with the first location 304A, the second location 304B, the third location 304C, the fourth location 304D, and the fifth location 304E.

In some embodiments, the server 102 may be configured to monitor the one or more social media posts stored in the social media server 110 (as represented by operation 306). The server 102 may be configured to select the subject-of-interest based on the one or more social media posts, as discussed in FIG. 1. In some embodiments, the server 102 may be configured to receive the user preferences (as represented by operation 308) from the broadcast-controller user 130 via the broadcast-controller terminal 114. In certain scenarios, the user preferences may indicate the first subject 108A to be the subject-of-interest. In accordance with an embodiment, the transceiver 208 may be configured to receive information associated with the focal lengths and the orientations of each of the plurality of image-capture devices 104 (as represented by operation 310). In accordance with the exemplary scenario 300, the first image-capture device 302A, the second image-capture device 302B, and the third image-capture device 302C may be focused on the first subject 108A. In such a case, the server 102 may be configured to select the first subject 108A as the subject-of-interest as discussed in FIG. 1. In some embodiments, the prediction system 210 may be configured to predict the subject-of-interest (as represented by operation 312).

In accordance with an embodiment, the server 102 may be configured to select the first subject 108A as the subject-of-interest based on the weight sum T(i) of the subject, as discussed in FIG. 1. After the first subject 108A is identified as the subject-of-interest, the server 102 may be configured to select a set of audio-capture devices comprising the second audio-capture device 106B, the third audio-capture device 106C and the fourth audio-capture device 106D based on the first location 304A of the first subject 108A. The selection of the set of audio-capture devices may be done based on a specified pattern similar to an arrangement of the plurality of speakers 124 in the multi-channel speaker system 120. For example, the consumer device 118 from which the request to reproduce sound environment for the perspective of the selected subject-of-interest is received, as the user preference may be connected to a 5.1 channel speaker system. In such a case, four audio-capture devices in the vicinity of the subject-of-interest may be selected based the positioning of the speakers in the 5.1 channel speaker system.

In one example, the multi-channel audio which may be generated by the server 102 may be the 5.1 channel audio. The server 102 may be configured to select one or more audio-capture devices from each of a front-left direction, a front-right direction, a rear-left direction, a rear-right direction with respect to the subject-of-interest (such as the first subject 108A in this case). In accordance with the exemplary scenario 300, the server 102 may be configured to select the second audio-capture device 106B from the front-left direction of the subject-of-interest, as shown. The server 102 may be configured to select the third audio-capture device 106C from the rear-left direction of the subject-of-interest. The server 102 may be configured to select the fourth audio-capture device 106D from the rear-right direction of the subject-of-interest. The server 102 may be configured to select the fifth audio-capture device 106E from the front-right direction of the subject-of-interest. The locations of the set of the audio-capture devices may be within proximity of the first location 304A of the selected subject-of-interest.

The first audio-capture device 106A, the second audio-capture device 106B, the third audio-capture device 106C, and the fourth audio-capture device 106D may be configured to capture audio from the defined area 134, as discussed in FIG. 1. The server 102 may be configured to receive a set of audio streams (such as a first audio stream, a second audio stream, a third audio stream, a fourth audio stream and a fifth audio stream) from the selected set of audio-capture devices. In accordance with the exemplary scenario 300, the processor 204 may be configured to calculate a set of position vectors between each of the set of subjects (who may be wearing the selected set of audio-capture devices) and the first subject 108A. The set of position vectors may comprise a first position vector 314A, a second position vector 314B, a third position vector 314C, and a fourth position vector 314D, as shown. The processor 204 may be configured to determine relative positions of the set of subjects with respect to the first subject 108A, by use of the calculated set of position vectors.

As the height of the set of subjects (who may be wearing the selected set of audio-capture devices) and the first subject 108A may be different, the height (or elevation) of each of the set of audio-capture devices worn by the set of subjects may be different. Thus, for the generation of the multi-channel audio that mimics the sound that may have been listened by the subject-of-interest (such as the first subject 108A in this case), each channel sound may be simulated or tuned based on the height of the subject (i.e. the height of each audio-capture device worn by the set of subjects). To simulate the sound, a transfer function may be derived. For example, the transfer function may be derived based on the set of audio streams received from the selected set of audio-capture devices. The set of audio streams may be re-recorded based on the relative positioning of the second audio-capture device 1066 (worn by the second subject 108B at the second location 304B), the third audio-capture device 106C (worn by the third subject 108C at the third location 304C, the fourth audio-capture device 106D (worn by the fourth subject 108D at the fourth location 304D), and the fifth audio-capture device 106E (placed at sport equipment) at the fifth location 304E with respect to the first audio-capture device 106A (worn by the first subject 108A at the first location 304A) in a three-dimensional space. In this case, the relative positioning refers to calculated set of position vectors and subject height, which may be the relative elevation and orientation of selected set of audio-capture devices with respect to each other in an N-channel pattern, such as the 5.1 channel arrangement. Thereafter, the processor 204 may be configured to assign each of the set of audio streams into a plurality of audio channels based on the set of position vectors. For example, the second audio stream from the second audio-capture device 106B may be assigned to the front-left channel. Further, the third audio stream from the third audio-capture device 106C may be assigned to the rear-left channel. The fourth audio stream may be assigned to the rear-right channel and the fifth audio stream may be assigned to the front-right channel. Each of the plurality of audio channels may correspond to one or more speakers in the multi-channel speaker system 120. Thereafter, the processor 204 may be configured to encode the set of audio streams into the multi-channel audio (by use of the multi-channel surround sound encoder 212), based on assignment of the set of audio streams to the plurality of audio channels.

Figure 4:
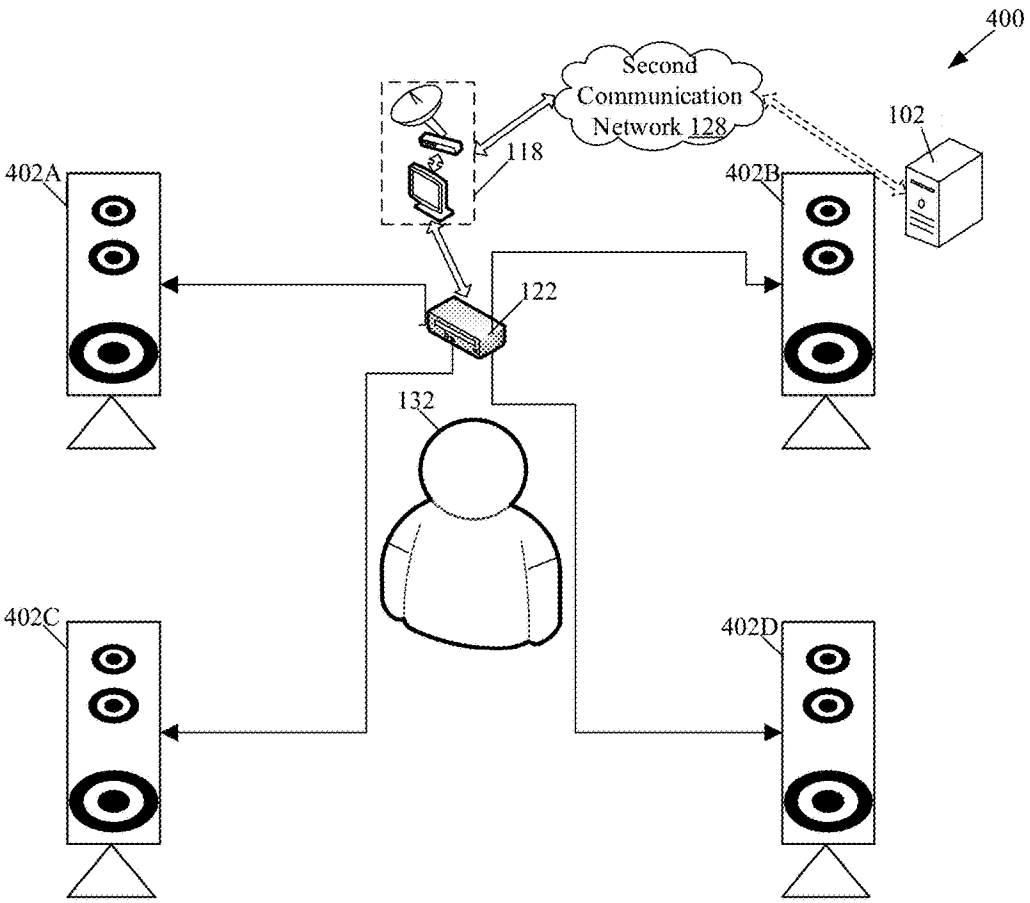
FIG. 4 illustrates a second exemplary scenario for implementation of the disclosed media content packaging and distribution system for dynamic generation of multi-channel audio from the perspective of a specific user, in accordance with an embodiment of the disclosure.

FIG. 4 illustrates an exemplary scenario for implementation of the disclosed system and method for packaging and distribution of media content for dynamic generation of multi-channel audio from the perspective of a specific user, in accordance with an embodiment of the disclosure. FIG. 4 is explained in conjunction with elements from FIGS. 1, 2 and 3. With reference to FIG. 4, there is shown an exemplary scenario 400. The exemplary scenario 400 may include the consumer device 118, the audio amplifier 122, and the plurality of speakers 124. The plurality of speakers 124 may comprise a front-left speaker 402A, a front-right speaker 402B, a rear-left speaker 402C, and a rear-right speaker 402D. The exemplary scenario 400 may further include the server 102, and the second communication network 128.

The consumer device 118 may be configured to receive the generated multi-channel audio from the server 102. In accordance with the exemplary scenario 400, the audio amplifier 122 may output the sound experienced by the first subject 108A at the first location 304A via the front-left speaker 402A, the front-right speaker 402B, the rear-left speaker 402C, and the rear-right speaker 402D. The sound output from the front-left speaker 402A may mimic (or may be an acoustic reproduction of) the sound that may be heard by the first subject 108A from the direction and an angle that corresponds to the height of the audio-capture device 106B placed on the second subject 108B. Similarly, the sound output from the front-right speaker 402B may mimic (or may be an acoustic reproduction of) the sound that may be heard by the first subject 108A from the direction and an angle that corresponds to the height of the audio-capture device 106E placed on the sports equipment. The sound output from the rear-left speaker 402C and the rear-right speaker 402D may mimic (or may be an acoustic reproduction of) the sound that may be heard by the first subject 108A from the respective directions and angles that correspond to heights of the audio-capture device 106C and the audio-capture device 106D respectively. Thus, the consumer 132 may experience a sense of immersion in an acoustic environment similar to that as experienced by the first subject 108A in the defined area 134.

Figure 5A:
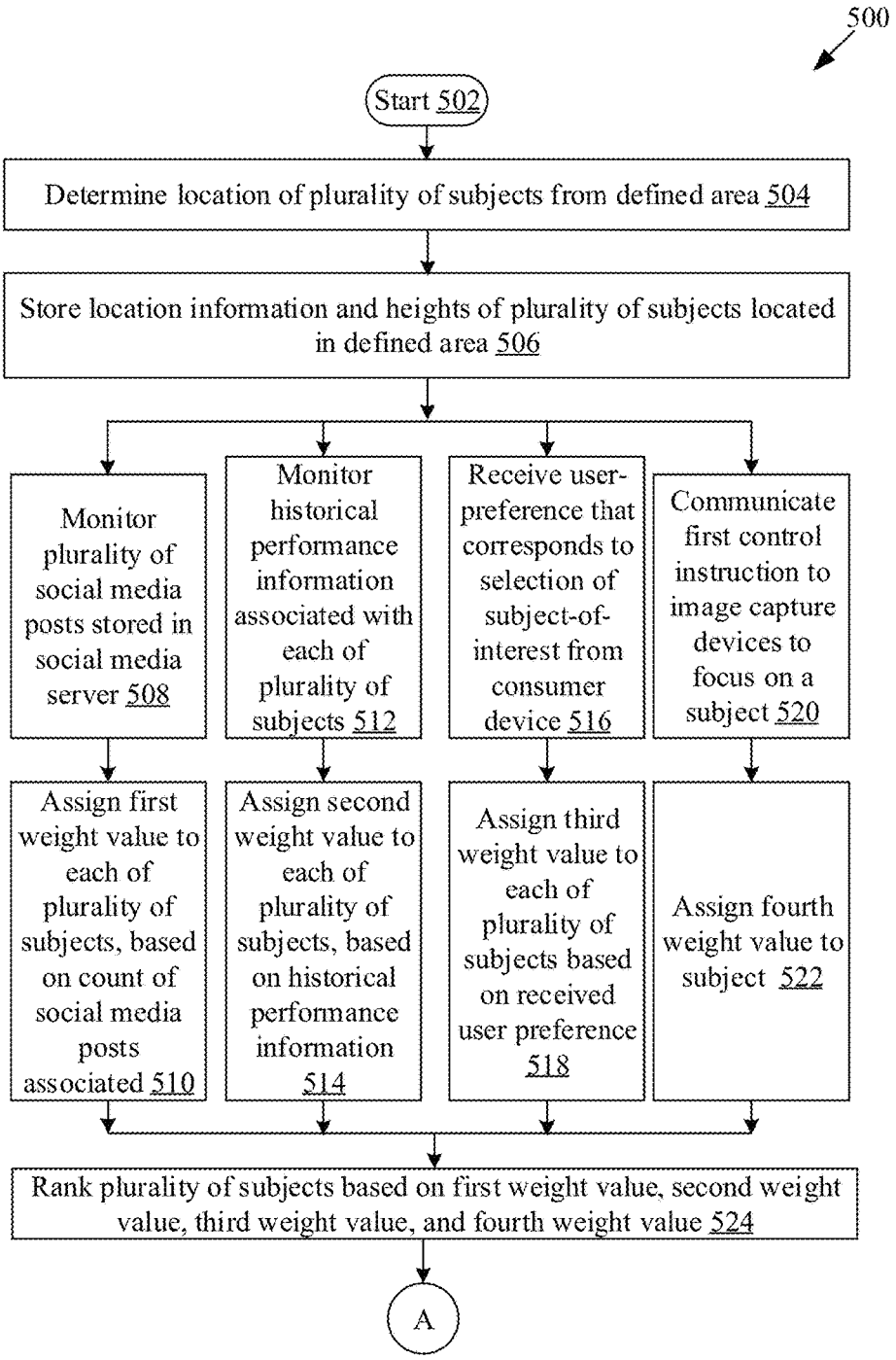
FIGS. 5A and 5B, collectively, depict a flow chart that illustrates an exemplary method of packaging and distributing media content for dynamic generation of multi-channel audio from the perspective of a specific user, in accordance with an embodiment of the disclosure.
Figure 5B:
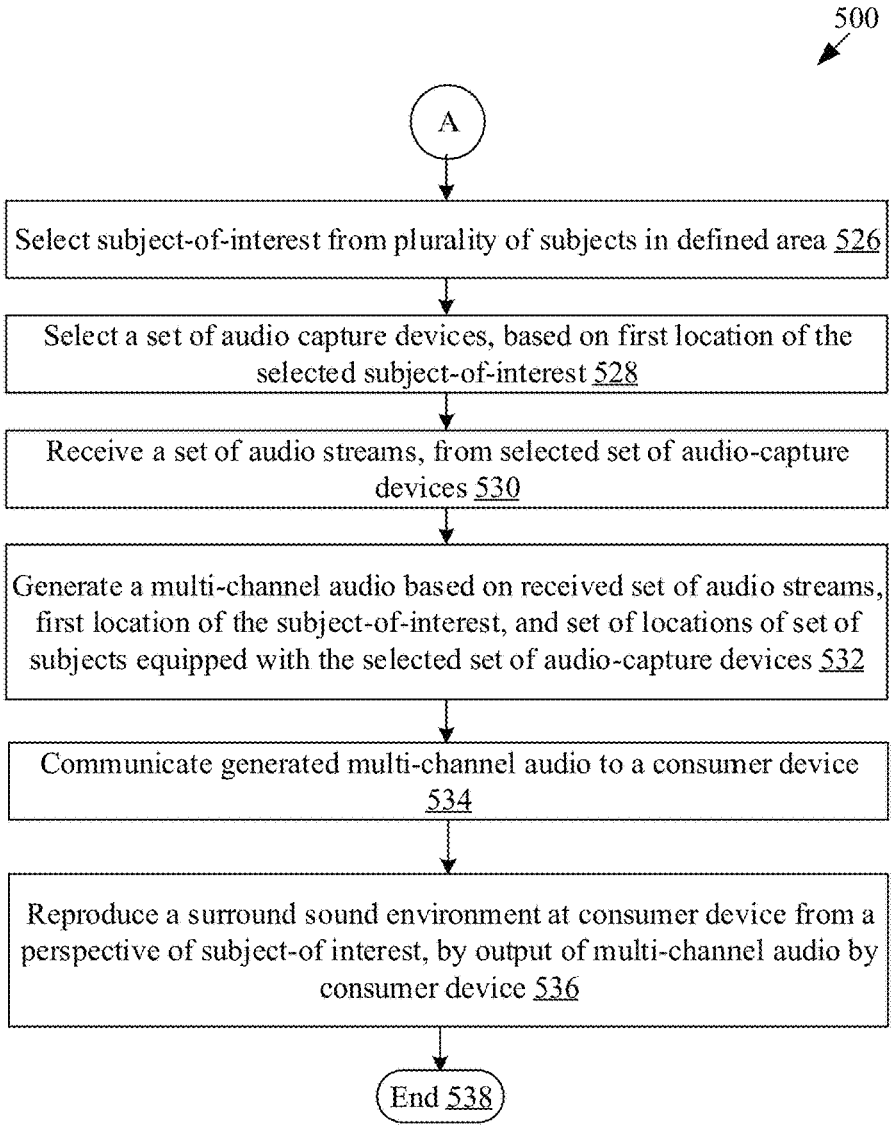

FIGS. 5A and 5B, collectively, depict a flow chart that illustrates an exemplary method for packaging and distribution of media content for dynamic generation of multi-channel audio from the perspective of a specific user, in accordance with an embodiment of the disclosure. With reference to FIG. 5A, there is shown a flow chart 500. The flow chart 500 is described in conjunction with FIGS. 1, and 2. The method starts at step 502 and proceeds to step 504.

At 504, locations of each of the plurality of subjects 108 may be determined by the server 102. In one example, the processor 204 may be configured to determine the locations by use of the plurality of audio-capture devices 106 or the plurality of image-capture devices 104, as discussed in FIG. 1.

At 506, information associated with location of the plurality of subjects 108 and elevation of the plurality of audio-capture devices 106 may be stored by the server 102. One or more operations, such as 508, 512, 516, and 520 may be executed concurrently, as shown. Therefore, the control may concurrently pass to 508, 512, 516, and 520.

At 508, the plurality of social media posts stored in the social media server 110, may be monitored by the server 102. The processor 204 may be configured to identify one or more social media posts from the plurality of social media posts which may be associated with one or more subjects of the plurality of subjects 108. In certain scenarios, the processor 204 may be configured to determine social media activity level, such as a count of social media posts, associated with each subject of the plurality of subjects 108. In accordance with an embodiment, the subject-of-interest may be selected based on the monitored plurality of social media posts.

At 510, each of the plurality of subjects 108 may be assigned with the first weight value W(i) by the server 102, based on the count of social media posts associated with the respective subject. The processor 204 may be configured to assign the first weight value W(i).

At 512, the historical performance information associated with each of the plurality of subjects 108, may be monitored by the server 102. The prediction system 210 in the server 102 may be configured to monitor the statistical data. In certain scenarios, the prediction system 210 may be configured to monitor the statistical data to predict the subject-of-interest.

At 514, each of the plurality of subjects 108 may be assigned with the second weight value X(i) by the server 102, based on the historical performance information associated with the respective subject. The processor 204 may be configured to assign the second weight value X(i) to the respective subject.

At 516, a user-preference that corresponds to a selection of the subject-of-interest may be received from the consumer device. In one example, one or more user interactions performed by a user (such as the consumer 132) on a control interface (of the consumer device 118) may be received by the server 102.

At 518, each of the plurality of subjects 108 may assigned with the third weight value Y(i) by the server 102, based on the received user preference. The processor 204 may be configured to assign the third weight value Y(i) based on the received user preference.

At 520, a first control instruction may be communicated by the server 102 to one or more image-capture devices of the plurality of image-capture devices 104. The processor 204 may be configured to communicate the first control instruction to instruct the one or more image-capture devices to focus on a particular subject of the plurality of subjects 108.

At 522, a particular subject may be assigned with the fourth weight value Z(i) by the server 102. For example, the processor 204 may be configured to assign the fourth weight value Z(i) to the particular subject in cases where the one or more image-capture devices may be focused on the particular subject.

At 524, the plurality of subjects 108 may be ranked by the server based on the plurality of weight values assigned to the plurality of subjects 108. The weight sum T(i) (of the first weight value W(i), the second weight value X(i), the third weight value Y(i), and the fourth weight value Z(i)) may be calculated by the server 102, as discussed in FIG. 1.

At 526, a subject from the plurality of subjects 108 may be selected by the server 102 as a subject-of-interest. The processor 204 may be configured to select the subject-of-interest based on the weight sum T(i) of the subject.

At 528, a set of audio-capture devices may be selected by the server 102 based on a first location of the selected subject-of-interest. The processor 204 may be configured to select the set of audio-capture devices located within proximity of the first location of the selected subject-of-interest.

At 530, the set of audio streams may be received by the server 102 from the selected set of audio-capture devices. The selected set of audio-capture devices may be configured to capture audio from a set of subjects associated with the selected set of audio-capture devices. An example of the selection of the set of audio-capture devices has been described in FIG. 3.

At 532, the multi-channel audio may be generated by the server 102, based on the set of received audio streams, the first location of the subject-of-interest and the set of locations of the set of audio-capture devices in the defined area 134. The multi-channel audio may be generated by the processor 204, by use of the multi-channel surround sound encoder 212, as discussed in FIG. 2.

At 534, the generated multi-channel audio may be communicated to consumer device 118 by the server 102. The processor 204 may be configured to communicate the generated multi-channel audio by use of the transceiver 208. In one embodiment, the processor 204 may be configured to communicate generated multi-channel audio to consumer device 118, via the second communication network 128, by use of the media packaging and distribution apparatus 116.

At 536, an acoustic environment in the proximity of the subject-of-interest in the defined area 134 may be reproduced by the consumer device 118. The acoustic environment may be reproduced as the surround sound environment at the consumer device 118 from a perspective of the subject-of interest, based on an output of the multi-channel audio by the consumer device 118. The control may pass to end 538.

In accordance with an embodiment of the disclosure, a system for packaging and distribution of media content is disclosed. The system may be implemented in a server (such as the server 102, (FIG. 1)) or an electronic device which may comprise a memory (such as the memory 206 (FIG. 2)) and a circuitry (such as the circuitry 202 (FIG. 2)). The memory 206 may be configured to store location information of a plurality of subjects (such as the plurality of subjects 108 (FIG. 1)) located in a defined area (such as the defined area 134 (FIG. 1)). Audio from each subject of the plurality of subjects 108 may be captured with at least one audio-capture device of a plurality of audio-capture devices (such as the plurality of audio-capture devices 106 (FIG. 1)). The circuitry 202 may be configured to select a subject-of-interest (e.g. a first subject 108A (FIG. 1)) from the plurality of subjects 108 in the defined area 134. The circuitry 202 may be further configured to select a set of audio-capture devices (e.g. audio-capture devices 106A, 106B, 106C, and 106D (FIG. 3)) from the plurality of audio-capture devices 106, based on a first location of the selected subject-of-interest. Moreover, the circuitry 202 may be configured to receive a set of audio streams from the selected set of audio-capture devices. The circuitry 202 may be configured to generate a multi-channel audio based on the received set of audio streams, the first location of the subject-of-interest, and a set of locations of a set of subjects equipped with the selected set of audio-capture devices. The circuitry 202 may be further configured to communicate the generated multi-channel audio to a consumer device (such as a consumer device 118 (FIG. 1)). An acoustic environment within proximity of the subject-of-interest in the defined area 134 may be reproduced as a surround sound environment at the consumer device 118 from a perspective of the subject-of interest, based on an output of the multi-channel audio by the consumer device 118.

Various embodiments of the disclosure may provide a non-transitory computer readable medium and/or storage medium having stored thereon, a set of instructions executable by a machine and/or a computer to generate one or more multi-dimensional videos. The at least one code section may cause the machine and/or computer to perform the steps that comprise storage of location information of a plurality of subjects located in a defined area, in a memory. Audio from each subject of the plurality of subjects may be captured with at least one audio-capture device of a plurality of audio-capture devices. Thereafter, a subject-of-interest may be selected from the plurality of subjects in the defined area. Further, a set of audio-capture devices may be selected from the plurality of audio-capture devices, based on a first location of the selected subject-of-interest. Moreover, a set of audio streams may be received from the selected set of audio-capture devices. A multi-channel audio may be generated based on the received set of audio streams, the first location of the subject-of-interest, and a set of locations of a set of subjects equipped with the selected set of audio-capture devices. The generated multi-channel audio may be communicated to a consumer device. An acoustic environment within proximity of the subject-of-interest in the defined area may be reproduced as a surround sound environment at the consumer device from a perspective of the subject-of interest, based on an output of the multi-channel audio by the consumer device.

The present disclosure may be realized in hardware, or a combination of hardware and software. The present disclosure may be realized in a centralized fashion, in at least one computer system, or in a distributed fashion, where different elements may be spread across several interconnected computer systems. A computer system or other apparatus adapted to carry out the methods described herein may be suited. A combination of hardware and software may be a general-purpose computer system with a computer program that, when loaded and executed, may control the computer system such that it carries out the methods described herein. The present disclosure may be realized in hardware that comprises a portion of an integrated circuit that also performs other functions.

The present disclosure may also be embedded in a computer program product, which comprises all the features that enable the implementation of the methods described herein, and which, when loaded in a computer system, is able to carry out these methods. Computer program, in the present context, means any expression, in any language, code or notation, of a set of instructions intended to cause a system with an information processing capability to perform a particular function either directly, or after either or both of the following: a) conversion to another language, code or notation; b) reproduction in a different material form.

While the present disclosure has been described with reference to certain embodiments, it will be understood by those skilled in the art that various changes may be made and equivalents may be substituted without deviation from the scope of the present disclosure. In addition, many modifications may be made to adapt a particular situation or material to the teachings of the present disclosure without deviation from its scope. Therefore, it is intended that the present disclosure not be limited to the particular embodiment disclosed, but that the present disclosure will include all embodiments falling within the scope of the appended claims.

What is claimed is:

1. A system for packaging and distribution of media content, comprising:

a memory configured to store location information of a plurality of subjects located in a defined area, wherein audio from each subject of the plurality of subjects is captured with at least one audio-capture device of a plurality of audio-capture devices; and circuitry configured to:

assign a weight to each subject of the plurality of subjects based on at least one of social media trends associated with each subject of the plurality of subjects or historical performance information of each subject of the plurality of subjects;

select a subject-of-interest from the plurality of subjects in the defined area based on the weight assigned to each subject of the plurality of subjects;

select a set of audio-capture devices from the plurality of audio-capture devices, based on a location of the selected subject-of-interest;

receive a set of audio streams from the selected set of audio-capture devices;

generate a multi-channel audio based on the received set of audio streams, the location of the subject-of-interest, and a set of locations of a set of subjects equipped with the selected set of audio-capture devices; and communicate the generated multi-channel audio to a consumer device, wherein an acoustic environment that surrounds the subject-of-interest in the defined area is reproduced as a surround sound environment at the consumer device from a perspective of the subject-of-interest, based on an output of the multi-channel audio by the consumer device.

2. The system according to claim 1, further comprising a prediction system, wherein the circuitry is further configured to predict the subject-of-interest from the plurality of subjects by the prediction system, based on the historical performance information of each subject of the plurality of subjects.

3. The system according to claim 1, wherein the circuitry is further configured to:

monitor one or more social media platforms;

determine a count of social media posts associated with each subject of the plurality of subjects in the monitored one or more social media platforms; and select the subject-of-interest based on the count of the social media posts, wherein a subject of the plurality of subjects associated with a highest count of the social media posts in the monitored one or more social media platforms in comparison to other subjects of the plurality of subjects is selected as the subject-of-interest.

4. The system according to claim 1, wherein the circuitry is further configured to:

receive a user-preference that corresponds to selection of the subject-of-interest from the consumer device communicatively coupled with the circuitry; and select the subject-of-interest based on the user-preference received from the consumer device.

5. The system according to claim 1, wherein the circuitry is further configured to:

communicate a control instruction to an image-capture device, communicatively coupled to the circuitry, to focus on a first subject of the plurality of subjects in the defined area; and select the first subject as the subject-of-interest.

6. The system according to claim 5, wherein the circuitry is further configured to determine the location of the subject-of-interest based on a focal length of the image-capture device and an orientation of the image-capture device.

7. The system according to claim 1, wherein the circuitry is further configured to select the set of audio-capture devices associated with the set of subjects based on proximity of the set of audio-capture devices to the location of the selected subject-of-interest.

8. The system according to claim 1, wherein the circuitry is further configured to receive location information of each audio-capture device from the plurality of audio-capture devices associated with the plurality of subjects, and wherein the location information of each audio-capture device indicates a location of each subject of the plurality of subjects in the defined area.

9. The system according to claim 1, wherein the circuitry is further configured to generate the multi-channel audio based on a relative position of each location of the set of locations with respect to the location of the subject-of-interest.

10. The system according to claim 1, wherein the circuitry is further configured to generate the multi-channel audio based on a relative elevation of each audio-capture device of the set of audio-capture devices, with respect to an audio-capture device of the subject-of-interest.

11. The system according to claim 1, wherein the circuitry is further configured to communicate the generated multi-channel audio to a multi-channel speaker system, wherein based on output of the multi-channel audio by the multi-channel speaker system, the surround sound environment is produced by the multi-channel speaker system from the perspective of the subject-of-interest, and wherein the surround sound environment produced from the perspective of the subject-of-interest is a simulation of the acoustic environment that surrounds the subject-of-interest in the defined area.

12. The system according to claim 1, further comprising a multi-channel surround sound encoder, wherein the circuitry is further configured to mix the received set of audio streams by the multi-channel surround sound encoder to generate the multi-channel audio.

13. The system according to claim 1, wherein the circuitry is further configured to:

receive a video from a video source communicatively coupled to the circuitry; and package the generated multi-channel audio with the received video to generate a media stream to be communicated to the consumer device.

14. The system according to claim 1, wherein the circuitry is further configured to generate the multi-channel audio based on a head related transfer function.

15. A method for packaging and distribution of media content, comprising:

in a server comprising a memory and circuitry:

storing, by the circuitry, location information of a plurality of subjects located in a defined area in the memory, wherein audio from each subject of the plurality of subjects is captured with at least one audio-capture device of a plurality of audio-capture devices;

assigning, by the circuitry, a weight to each subject of the plurality of subjects based on at least one of social media trends associated with each subject of the plurality of subjects or historical performance information of each subject of the plurality of subjects;

selecting, by the circuitry, a subject-of-interest from the plurality of subjects in the defined area based on the weight assigned to each subject of the plurality of subjects;

selecting, by the circuitry, a set of audio-capture devices from the plurality of audio-capture devices, based on a first location of the selected subject-of-interest;

receiving, by the circuitry, a set of audio streams from the selected set of audio-capture devices;

generating, by the circuitry, a multi-channel audio based on the received set of audio streams, the location of the subject-of-interest, and a set of locations of a set of subjects equipped with the selected set of audio-capture devices; and communicating, by the circuitry, the generated multi-channel audio to a consumer device, wherein an acoustic environment within proximity of the subject-of-interest in the defined area is reproduced as a surround sound environment at the consumer device from a perspective of the subject-of-interest, based on an output of the multi-channel audio by the consumer device.

16. The method according to claim 15, further comprising predicting, by the circuitry, the subject-of-interest from the plurality of subjects, based on the historical performance information of each subject of the plurality of subjects.

17. The method according to claim 15, further comprising:

monitoring, by the circuitry, one or more social media platforms;

determining a count of social media posts associated with each subject of the plurality of subjects in the monitored one or more social media platforms; and selecting the subject-of-interest based on the count of the social media posts, wherein a subject of the plurality of subjects associated with a highest count of the social media posts in the monitored one or more social media platforms in comparison to other subjects of the plurality of subjects is selected as the subject-of-interest.

18. The method according to claim 15, further comprising:

receiving, by the circuitry, a user-preference that corresponds to selection of the subject-of-interest from the consumer device communicatively coupled with the circuitry; and selecting the subject-of-interest based on the user-preference received from the consumer device.

19. The method according to claim 15, further comprising:

communicating, by the circuitry, a control instruction to an image-capture device communicatively coupled to the circuitry, to focus on a first subject of the plurality of subjects in the defined area; and selecting, by the circuitry, the first subject as the subject-of-interest.

20. The method according to claim 19, further comprising determining, by the circuitry, the location of the subject-of-interest, based on a focal length of the image-capture device and an orientation of the image-capture device.

* * * * *